United States Patent [19]

Deville et al.

[11] Patent Number: 4,993,711

[45] Date of Patent: Feb. 19, 1991

[54] TENNIS RACKET WITH VIBRATION-DAMPING STRINGING

[75] Inventors: Dominique Deville, Saint Etienne de Crossey; Gilles Du Gardin, Voiron, both of France

[73] Assignee: Societe Skis Rossignol S.A., Voiron, France

[21] Appl. No.: 470,936

[22] Filed: Jan. 26, 1990

Related U.S. Application Data

[63] Continuation of Ser. No. 34,886, Apr. 6, 1987, Pat. No. 4,909,511.

[30] Foreign Application Priority Data

Apr. 8, 1986 [FR] France ..... 86 05479

[51] Int. Cl.[5] ..... A63B 49/14

[52] U.S. Cl. ..... 273/73 D

[58] Field of Search ..... 273/73 R, 73 A, 73 C, 273/73 D

[56] References Cited

U.S. PATENT DOCUMENTS

| | | | |
|---|---|---|---|
| 1,697,814 | 1/1929 | Forbes | 273/73 D |
| 3,567,225 | 3/1971 | Hollis | 273/73 D |
| 3,642,283 | 2/1972 | Wilkens | 273/73 D |
| 3,990,701 | 11/1976 | Kim | 273/73 D |
| 4,204,681 | 5/1980 | Hall, Jr. et al. | 273/73 C |

*Primary Examiner*—Edward M. Coven
*Assistant Examiner*—William E. Stoll
*Attorney, Agent, or Firm*—Herbert Dubno; Andrew M. Wilford

[57] ABSTRACT

A racket for a racket sport has a frame having a handle and an annular frame head carried on the handle and formed with throughgoing stringing holes each having an outer end and an inner end. Liners define rigid edges around the outer edges of at least selected ones of the holes and strings pass through the holes in the frame, those strings passing through the selected ones of the holes being bent around and in contact with the rigid edges thereof. Respective pliable washers received in the selected ones of the holes offset from the respective ridged edges thereof each have an inner periphery elastically hugging the string traversing the respective hole for damping vibration in the head and an outer periphery fixed relative to the frame head.

9 Claims, 2 Drawing Sheets

TENNIS RACKET WITH VIBRATION-DAMPING STRINGING

This is a continuation of co-pending application Ser. No. 07/034,886 filed on Apr. 6, 1987, now U.S. Pat. No. 4,909,511.

FIELD OF THE INVENTION

Our present invention relates to a strung racket, e.g. for tennis, badminton, squash, racketball and other racket sports, which is provided with means for damping the vibration of the stringing spanning the frame of the racket head.

The invention particularly relates to an improved vibration-damping device utilized to secure the stringing to the frame.

BACKGROUND OF THE INVENTION

A tennis racket, like other rackets for use in racket sports, e.g. tennis, squash, badminton and racketball, comprises a handle formed with a grip, a shaft connected to the handle and generally extending therefrom to a throat of the racket and a head which is formed with a frame spanned by an openwork which is generally referred to as stringing and can be composed of main strings which run parallel to the axis of the racket and cross strings which run transversely thereto The strings can be composed of synthetic resin, e.g. nylon, or a natural material and the head can be circular or oval, i.e. generally round. The stringing forms a striking face of the racket and the central zone thereof is generally referred to as the "sweet spot" to indicate that a blow applied to the ball in this region will permit best control of the direction of the ball, most effective transfer of energy to the ball, and least torsion or twist by reaction forces on the racket which may cause discomfiture for the player.

The cords or strings generally pass through the frame body through so-called string holes.

The base of the head located adjacent the throat generally forms a bridge between two shoulders of the frame which are extended toward the free end of the latter which can be referred to as the crown.

While we may refer, in this description, to a tennis racket, it should be understood that this term is intended to include similar rackets for the other racket sports described as well as rackets for other sports which may not have been mentioned but which nevertheless may use a strung racket.

Conventional rackets of the type described have, as a significant disadvantage, the lack of any mean for effectively damping the vibration of the strings resulting from impact with the ball. While the handle and frame of a racket may be designed to minimize the transfer of vibration from the stringing to the hand and arm of the player, the fact remains that the absence of an effective damping device between the stringing and the head or frame of the racket results in a transfer of significant vibrational energy to the head and then through the handle to the arm of the user, regardless of how effective the vibration-damping effect of the handle and shaft may be and regardless of the materials from which the racket body may be constructed to resist the generation of sympathetic vibration and their transfer to the arms of the user.

In addition, the lack of any vibration-damping at the strings themselves results in the generation of disagreeable sounds between the devices generally provided between the frame and the string to permit passage of the string or cord without deterioration thereof. For example, without such protective devices, e.g. in the form of eyelets or tubular string protectors, a string passing through a tubular bridge or frame part of the racket may be subjected to considerable stress at the edge of the string hole which can cause wear of the string or a slicing action even after relatively limited use.

Thus while such protective means may be essential for at least certain types of racket, the very existence of such means results in the generation of noise upon impact of the stringing with the ball which is a drawback as mentioned above.

OBJECTS OF THE INVENTION

It is, therefore, the principal object of the present invention to provide an improved racket with string-vibration damping which will eliminate the drawbacks mentioned above.

Yet another object of this invention is to provide an improved racket which has means for damping vibration of the strings upon impact with the ball so as to eliminate the undesirable noises described above and reduce the strain on the arm of the user resulting from transmission of such vibration.

SUMMARY OF THE INVENTION

These objects and others which become apparent hereinafter are attained, in accordance with the invention by providing in at least one and preferably all of the string holes of at least the bottom of the frame and preferably all of the lower holes on the side of the frame opposite the crown and traversed by the longitudinal or main strings, respective annular pliable membranes, each of which is fixed in the hole and has, in turn, an orifice traversed by and distended by the respective string and whose edge huggingly engages the string.

According to a feature of the invention, the annular pliable membrane is fixed in a respective tubular member, i.e. the eye or sleeve mentioned earlier and intended to prevent cutting or local wear of the string where it passes through the respective string hole.

The pliable member can be composed of a soft rubber.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
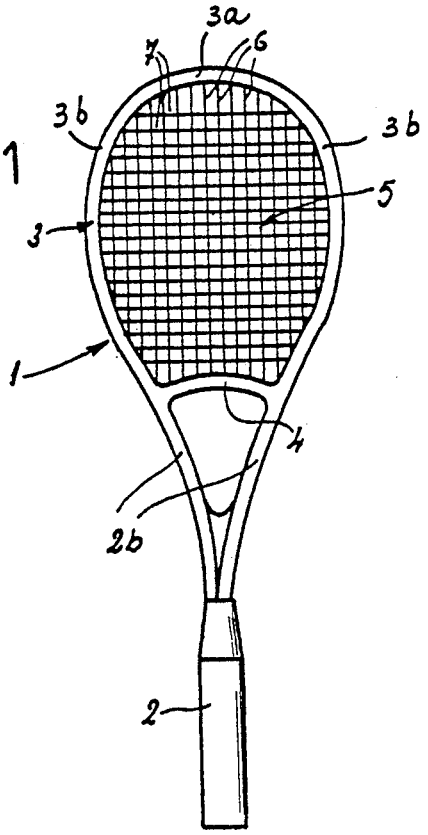
FIG. 1 is an elevational view of a racket provided with the vibration-damping means of the present invention.
Figure 2:
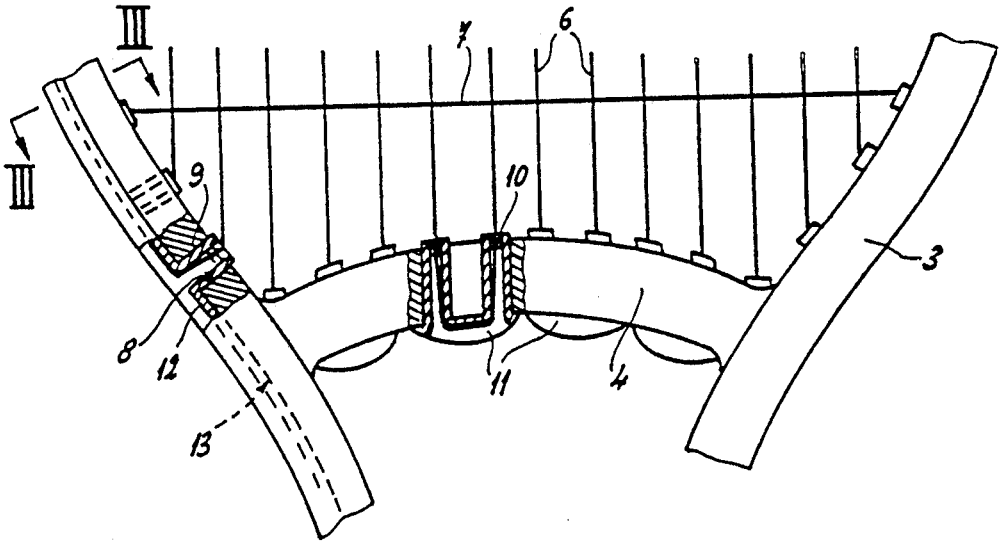
FIG. 2 is a detail view drawn to a substantially larger scale than FIG. 1 and diagrammatically illustrating, with parts broken away, the lower part or bottom of the head of the racket of FIG. 1.
Figure 3:
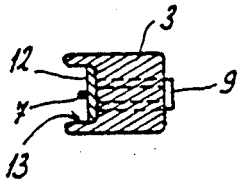
FIG. 3 is a section taken along the line III—III of FIG. 2.

FIGS. 1–3 show a tennis racket which has a handle 2 provided with the usual grip, and two arms 2*b* which extend from the handle to form a shaft and which then merge into the head 3 of the racket which is in the form of a frame having a crown 3*a* and two sides 3*b*. The bottom of the frame is formed by the bridge 4.

The head 3 includes a stringing 5 forming the striking surface and spanning the frame.

The stringing 5 is composed of longitudinal or main strings or cords 6 and transverse cords or strings 7.

As can be seen in FIG. 2, each string is fixed to the head or frame by traversing a respective one of the string holes 8 formed in the body of the frame and, more specifically, a respective tubular sleeve or liner 9 which may be referred to as a "cannon" or eye and which is composed, for example, of a polyamide and is used to prevent cutting of the string by the edges of the hole 8. These sleeves 9 are fixed in the holes 8.

According to the invention a respective pliable annular member 10 composed of an elastomer, for example a long-wearing but soft rubber, is fixed by force-fitting it or gluing it into each of the sleeves 9 at least of the bridge 4 and preferably all of the sleeves 9 receiving the lower ends of the longitudinal or main strings 6.

Of course, all of the strings can be damped with such membranes in the respective sleeves 9 or holes.

In the preferred embodiment of the invention, each member 10 is fixed proximal to the inner end of the sleeve 9 and hence the hole 8, i.e. the end closest toward the sweet spot of the stringing 5.

To provide the damping effect which is desired, each of these membranes 10 has a central orifice 14 whose diameter is less than that of the respective string 6 before that string is pulled through the orifice so that the membrane is distended around the orifice by pulling the string therethrough. As a result, the edge of the orifice strongly hugs the string (see FIG. 5).

It is possible to form each membrane 10 at the same time as the sleeve 9 receiving it by a bi-injection process or by injecting or otherwise forming a membrane after the sleeve has been formed but another simple method of forming one part within another may also be used.

Of course, the sleeve 9 can be omitted in the most general version of the invention, in which case the membrane 10 is lodged in the hole 8 directly, e.g. by adhesive bonding or a clamping action.

Each membrane 10 and the respective sleeve 9 can be formed as a unit, or as can be seen in FIG. 2, the sleeves can be formed by injection molding in pairs which are interconnected and can then be provided with the membranes.

In a particularly advantageous construction, best seen in FIG. 2, the bridge 4 is provided with four stringing riders 11 molded in a single piece and extending over the major part of the center of the bridge 4 with holes to permit passage of the longitudinal strings. The riders can carry the sleeves 9. Over the sides and crown of the frame, the sleeves 9 can be molded in a single piece on a common web 12 which is received in a groove 13 along the exterior of the head 3 (FIG. 3).

Figure 4:
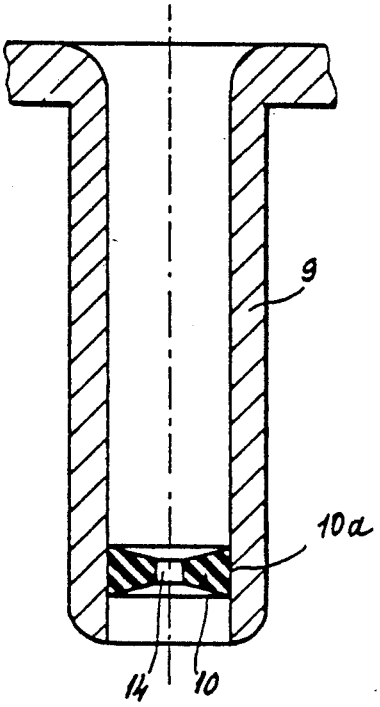
FIG. 4 is a longitudinal section through one of the protective sleeves or "cannons" which is intended to be traversed by a string and to line or form one of the stringing holes, before the respective string has been passed therethrough.

In FIG. 4 we have shown one of the sleeves 9 provided with its membrane 10 and orifice 14 before a string has been threaded through this membrane.

The membrane has the configuration of a disk with double conical recesses, i.e. similar conical recesses on opposite ends or faces.

Figure 5:
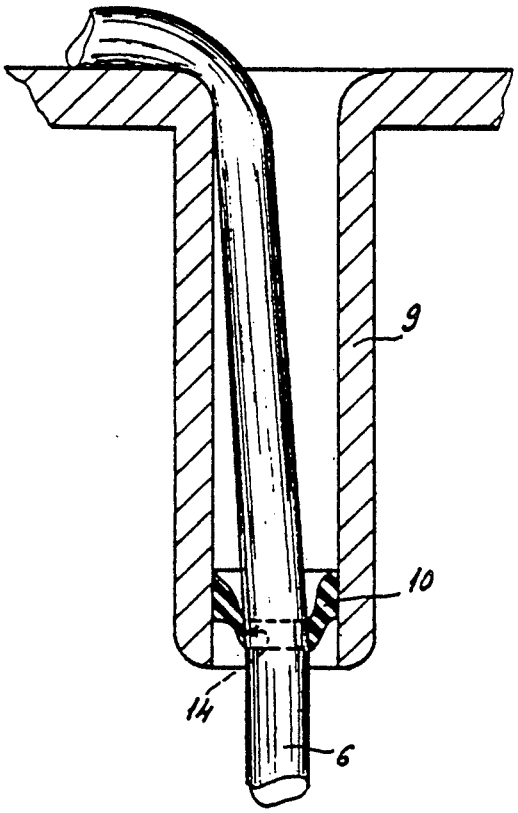
FIG. 5 is a view similar to FIG. 4 but illustrating the damper device after the string has been passed through the sleeve and the membrane.

FIG. 5 shows the same sleeve 9 after the cord 6 has been passed therethrough and tensioned. The membrane 10 is strongly deformed toward the interior of the racket, the orifice 14 has been strongly distended and thus resiliently hugs or grips the string 6, and a permanent zone of contact is created between the membrane and the strong. The membrane is cemented at 10*a* to the interior of the sleeve 9.

Experience has shown that when the stringing impacts against the ball, any vibration set up in the stringing tends to be damped by the compression and distortion of the membrane, eliminating noise where the strings might otherwise slap against the sleeves, and the transmission of significant vibration of the handle or shaft.

The vibration-damping membranes or disks can also be provided at the crown ends of the longitudinal strings as well as for both ends of the transverse strings

We claim:

1. A racket for a racket sport, the racket comprising:

a frame having a frame head and a handle affixed to the head, the head being formed with an externally open groove and having a crown, a bottom spaced toward the handle from the crown, and a pair of spaced sides extending between the bottom and the crown, said frame being formed with stringing holes;

a rigid liner defining respective passages aligned with at least some of said holes;

stringing including longitudinal strings passing through said holes in said frame between said crown and said bottom and transverse strings passing through said holes in said frame between the sides of said head, the strings passing through said some of said holes being bent around and in contact with said liner at a base of said groove; and a respective pliable membrane received in each of the holes traversed by a string bent around and in contact with said liner at said base of said groove and having an inner periphery hugging the string and in contact on at least two opposite sides of the string for damping vibration in said head.

2. The racket defined in claim 1 wherein said membranes are flat disks prior to engagement by the strings traversing same and having frustoconical convex recesses on opposite sides of said disks.

3. The racket defined in claim 1 wherein said liner is a strip of plastic lying in said groove.

4. The racket defined in claim 3 wherein said liner is formed with respective sleeves extending into said holes and surrounding the respective strings.

5. A racket for a racket sport, the racket comprising:

a frame having a frame head and a handle affixed thereto, the head being formed with an externally open groove and having a crown, a bottom spaced toward the handle from the crown, and a pair of spaced-apart sides extending between the bottom and the crown, said frame head being formed with stringing holes;

a liner defining rigid edges around at least some of said holes;

stringing including longitudinal strings passing through said holes in said frame between said crown and said bottom and transverse strings passing through said holes in said frame between the sides of said head, the strings passing through said some of said holes being bent around and in contact with said rigid edges at a base of said groove; and a respective pliable membrane received in each of the holes traversed by a string bent around and in contact with a respective one of said edges at said base of said groove and having an inner periphery hugging the respective string and in contact on at least two opposite sides of the string for damping vibration in said head.

6. The racket defined in claim 5 wherein said membranes are in the form of flat disks prior to engagement by the strings traversing same and having frustoconical convex recesses on opposite sides of said disks.

7. A racket for a racket sport, the racket comprising:

a frame having a handle and an annular frame head carried on the handle and formed with throughgoing stringing holes each having an outer end and an inner end;

liners defining rigid edges around the outer edges of at least selected ones of the holes;

strings passing through the holes in the frame, the strings passing through the selected ones of the holes being bent around and in contact with the rigid edges thereof; and respective pliable washers received in the selected ones of the holes offset from the respective ridged edges thereof and each having an inner periphery elastically hugging the string traversing the respective hole and in contact on at least two opposite sides of the string for damping vibration in the head and an outer periphery fixed relative to the frame head.

8. The racket defined in claim 7 wherein each inner periphery is in tight all-around contact with the respective string and each outer periphery is in all-around contact with the respective hole.

9. The racket defined in claim 8, further comprising means for adhering the outer peripheries of the disks in the respective holes.

* * * * *